United States Patent [19]

Davis et al.

[11] Patent Number: 4,849,948

[45] Date of Patent: Jul. 18, 1989

[54] SELF-CONTAINED DISPOSABLE TIMER FOR USE WITH MEDICATION

[75] Inventors: Bradley D. Davis, Gresham; Judson C. Groshong, Beaverton; Leonard J. Marcel, Lake Oswego, all of Oreg.

[73] Assignee: Medalarm Corporation, Portland, Oreg.

[21] Appl. No.: 46,518

[22] Filed: May 6, 1987

[51] Int. Cl.[4] ..... G04B 47/00; G04F 8/00

[52] U.S. Cl. ..... 368/10; 368/109; 368/251; 368/321

[58] Field of Search ..... 368/10, 107–113, 368/89, 90, 97, 72–74, 250, 251; 221/2, 3, 15; 340/309.15, 309.4; 364/569, 705

[56] References Cited

U.S. PATENT DOCUMENTS

| | | | |
|---|---|---|---|
| 4,062,181 | 12/1977 | Zurgher | 364/705 |
| 4,195,471 | 4/1980 | Verhoeven | 368/90 |
| 4,258,354 | 3/1981 | Carmen et al. | 368/10 |
| 4,345,541 | 8/1982 | Villa-Real | 368/89 |
| 4,361,408 | 11/1982 | Wirtschafter | 368/10 |
| 4,382,688 | 5/1983 | Machamer | 368/10 |
| 4,382,700 | 5/1983 | Youngren | 368/327 |
| 4,419,016 | 12/1983 | Zoltan | 368/10 |
| 4,451,158 | 5/1984 | Selwyn et al. | 368/63 |
| 4,483,626 | 11/1984 | Noble | 368/10 |
| 4,490,711 | 12/1984 | Johnston | 368/10 |
| 4,493,043 | 1/1985 | Forbath | 368/251 |
| 4,504,153 | 3/1985 | Schollmeyer et al. | 368/10 |
| 4,526,474 | 7/1985 | Simon | 368/10 |

FOREIGN PATENT DOCUMENTS

| | | | |
|---|---|---|---|
| WO86/01922 | 3/1986 | PCT Int'l Appl. | 368/90 |

*Primary Examiner*—Vit W. Miska

*Attorney, Agent, or Firm*—Chernoff, Vilhauer, McClung & Stenzel

[57] ABSTRACT

A highly portable, disposable, self-contained timer provides a user-perceptible signal at automatically-successive, fixed time intervals to alert the user as to the times for taking medications. The time intervals are not variably programmable, and different timers having different fixed time intervals are provided for use with different medications. Preferably, the time intervals are nonuniform, comprising multiple shorter intervals combined with a longer interval corresponding to a normal sleeping period so that, when the timer is initialized in accordance with the user's sleeping cycle, no signal is emitted while the user is asleep. The device is powered by a nonreplaceable battery for economy and disposability, and a deactivator circuit is included which permanently disables the unit after a predetermined length of time well within the life of the battery. A signal emitted by one of a number of timers is easily distinguished, without requiring an audible signal of excessive duration, by a visual signal of substantially longer duration than the audible signal.

14 Claims, 4 Drawing Sheets

DECODER

SIGNAL MODULE

CLOCK

FIG. 10
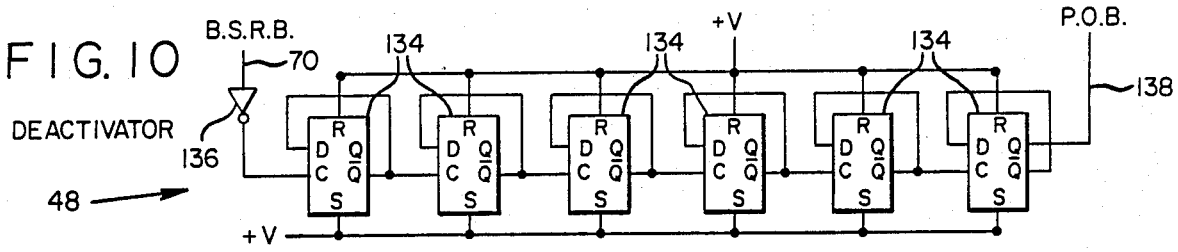
FIG. 11
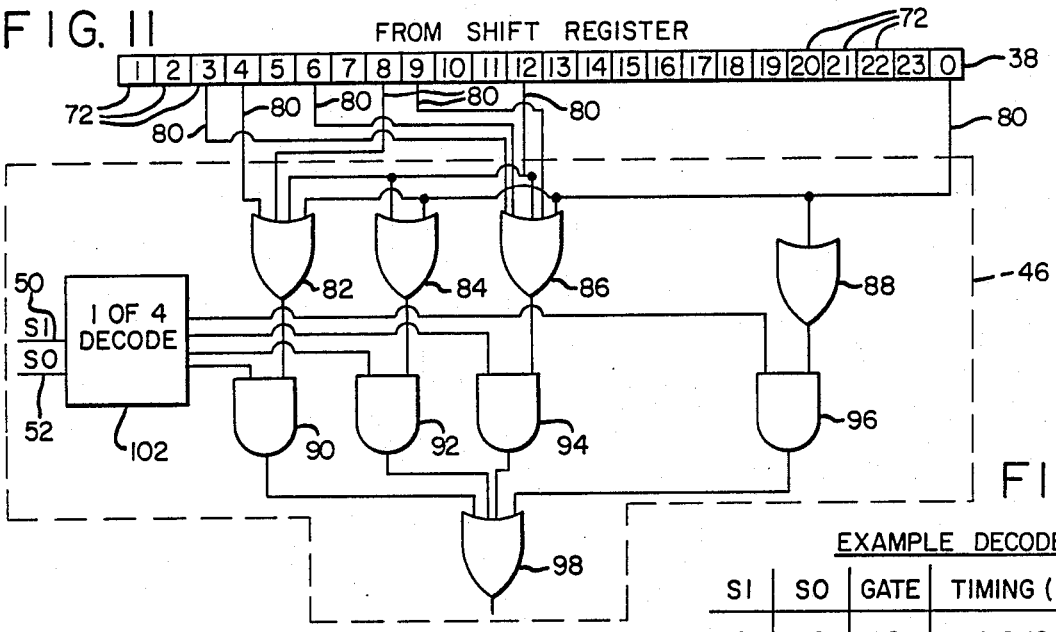
FIG. 12
EXAMPLE DECODES
| S1 | S0 | GATE | TIMING (HOURS) |
|---|---|---|---|
| 0 | 0 | 90 | 4,8,12,24 |
| 0 | 1 | 92 | 12,24 |
| 1 | 0 | 94 | 3,6,9,12,24 |
| 1 | 1 | 96 | 24 |
FIG. 13
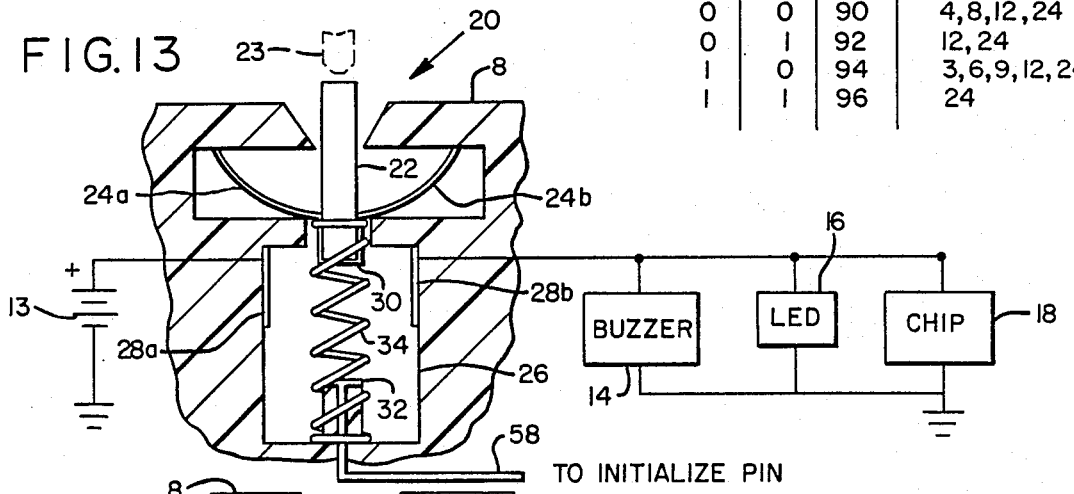
FIG. 14
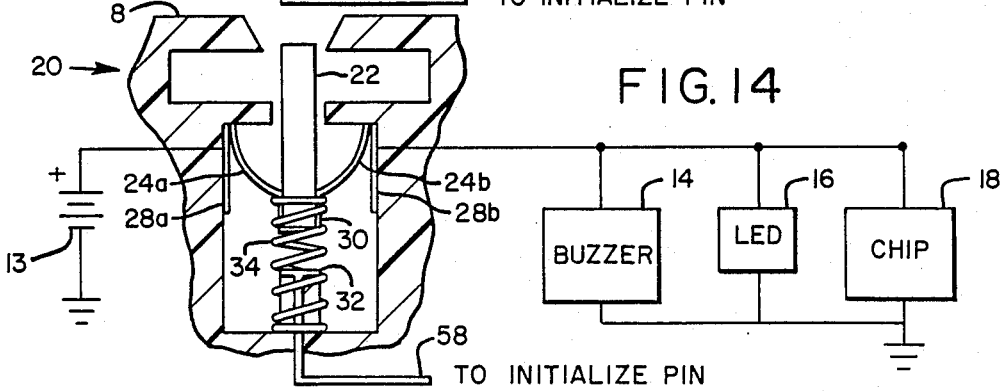

SELF-CONTAINED DISPOSABLE TIMER FOR USE WITH MEDICATION

BACKGROUND OF THE INVENTION

The present invention relates to a timer and more particularly to a self-contained disposable timer which is intended to be used in conjuction with the taking of medication.

Persons who have been instructed to take prescription medication often need to be reminded as to when such medication should be taken. In the past, various types of timers have been included with medication containers or pill boxes for alerting the user by means of an audible beep and/or flashing light at certain predetermined time intervals that another dose of medication should be taken. An example of such devices is shown in Noble U.S. Pat. No. 4,483,626. The Noble device includes a rotary dial connected to a timing circuit for programming a variable alarm interval for different medications. At the end of each interval an alarm sounds and an LED flashes, reminding the user to take the medication. A disadvantage of such variably programmable devices is that, due to their variable interval controls and related circuitry, they are generally too expensive to justify their function. Moreover, although programmability may be a desirable feature for some users, for many patients programming may be too complicated and/or require manual dexterity that these users do not possess.

A further disadvantage of such prior devices is that the selected interval of such devices repeats indefinitely in a uniform manner until the device is turned off. This means that the alarm sounds at uniform intervals throughout the day and night, even when the user is normally asleep, unless the device is turned off which is not advisable since the user could forget to reset it the next morning.

Similar examples of medication reminders may be found in Machamer U.S Pat. No. 4,382,688, Wirtschafter U.S. Pat. No. 4,361,408, Zoltan U.S. Pat. No. 4,419,016, and Simon U.S. Pat. No. 4,526,474, as well as in other types of special purpose timers such as those shown in Selwyn et al U.S. Pat. No. 4,451,158 and Forbath U.S. Pat. No. 4,493,043. These devices likewise require a number of external switches and related circuitry for the programming of the timer so as to provide audible and/or visual signals to the user at variable intervals of time. And, despite their complexity, the circuits of these devices are incapable of providing alarm signals at automatically successive, non-uniform time intervals such that intervals of uniform duration, corresponding to the intervals for taking a medication, are interspersed with longer intervals corresponding to normal sleeping periods to avoid disturbing the user.

At least one medication timer has been marketed wherein the alarm intervals are uniform fixed intervals rather than variable ones. However, the intervals of such device are not automatically successive and must be initiated by resetting the device after each alarm. Such resetting occurs in response to the removal of the cap of a medication container to which the device is connected. The necessity of connecting the device to a medication container for this purpose, however, limits the device's portability and thus makes it difficult to maintain the device within hearing of the user at all times since most medication users do not carry large, bulky medication containers on their person.

Yet another problem common to all of the above devices is that, as all are battery powered, their operation may become erratic when the battery runs down. This could result in incorrect alarm signals and resultant incorrect medication dosages until the battery is replaced.

Also, replaceable batteries make the prior device both more expensive and less reliable due to the need for an openable and closeable battery compartment and detachable battery contacts, the latter being inherently unreliable unless the mechanical contacts are very well made.

Finally, persons using multiple prior art devices with audible alarms for multiple medications can have difficulty determining which device has sounded its alarm, unless the alarm is actuated for a relatively long period of time, causing excessive battery power consumption and noise disturbance.

SUMMARY OF THE INVENTION

The above-described problems are solved by the present invention, which comprises a highly portable self-contained timer which provides a user-perceptible signal at automatically successive, fixed time intervals and is sufficiently simple and thus inexpensive to be disposable. The user cannot program the time intervals, but relies upon colorcoding or other fixed visual indicia on the housing of the timer to provide information as to the pattern of time intervals provided by that particular unit. Different units having different fixed time intervals and different visual indicia are supplied from which the user can select the unit having the appropriate intervals for a particular medication.

The timer's only control is an externally accessible switch for permanently energizing and for selectively initializing and reinititalizing the timer. A clock having a clock cycle provides at least one pulse signal at a predetermined regular time interval within the clock cycle. A shift register responds to the pulse signal by providing timing command signals at predetermined times within the clock cycle, and a decoder responsive to the output of the shift register selects a pattern of command signals separated by fixed time intervals. An alarm which may be audible, visual, or both responds to the pattern of command signals and provides the user-perceptible signal at the fixed time intervals.

The pattern of timing command signals preferably, but not necessarily, contains non-uniform time intervals which include multiple shorter intervals combined with a longer interval corresponding to a normal sleeping period. The pattern repeats once every 24 hours, so that no command signals occur during normal sleeping hours if the timer is initialized in accordance with the user's sleeping cycle. The timer may be synchronized to this cycle by depressing an initializer switch at or near the beginning of the user's normal waking hours. The same switch reinitializes the timer if necessary.

The timer is enclosed within a housing which may be associated with a container for holding medicine or, for greater portability, may be carried separately in a pocket or change purse or attached to a chain or clothing. The housing is small enough to be affixed to a key chain or serve as a lapel pin.

Within the housing are a timing circuit, an alarm, and a non-replaceable battery permanently encapsulated within the housing so that the entire unit is disposable.

A deactivator circuit is included which permanently disables the unit after a predetermined length of time well within the life of the battery powering the unit.

The externally accessible switch contains permanently latching electrical contacts which energize the unit by activating the battery such that, once energized, the unit cannot be disabled until the deactivator circuit does so automatically at a later time.

An alarm sounded by one of a number of timers for a user of multiple medications is easily distinguished from the others, without requiring an audible signal of excessive duration, by providing a visual signal of substantially longer duration than the audible signal.

Although the timer is primarily intended for use by persons in connection with the taking of medications, it is not limited to such uses and may find application in other fields such as the timing of automated devices, in which case its alarm signal may not be user-perceptible.

It is therefore a primary object of this inventon to provide a highly portable and versatile, yet simple and disposable, timer to be used in conjunction with the taking of medications.

More specifically, it is an object of this invention to provide a timer, having automatically succesive, fixed alarm intervals to eliminate the expense and complexity of providing programmability and to maximize the portability and reliability of the timer.

A further object of this invention is to provide a timer having a timing pattern for generating alarm signals at automatically successive, non-uniform intervals so that the alarm will not sound during normal sleeping hours.

A still further object of this invention is to provide a timer wherein the battery is permanently encapsulated within a housing for economy and disposability, and which includes a deactivator circuit to permanently disable the timer after a predetermined period of time while the battery remains operative, to insure reliability.

A still further object of this invention is to facilitate the identification by the user of which one of a number of timers has sounded its alarm, without requiring a prolonged audible alarm to do so.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 10 is a schematic diagram of the deactivator module of FIG. 4.

FIG. 11 is a schematic diagram illustrating an exemplary interconnection of the shift register and decoder modules of FIG. 4.

FIG. 12 is a truth table illustrating the method of operation of the embodiment of FIG. 11.

FIG. 13 is a schematic diagram of the externally accessible switch in an unlatched position preparatory to energizing the circuit of FIG. 4.

FIG. 14 is a schematic diagram of the switch of FIG. 13 in a latched position.

DETAILED DESCRIPTION OF THE INVENTION

Figure 1:
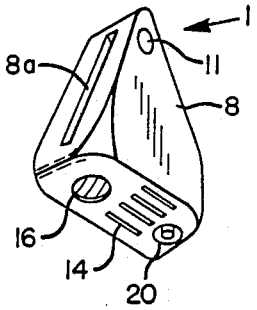
FIGS. 1 and 1*a* are perspective views of an exemplary self-contained timer, illustrated as a separate portable unit.
Figure 1A:
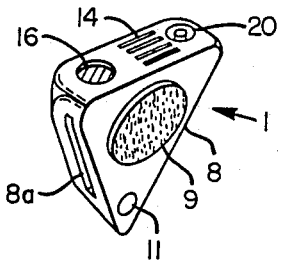
Figure 2:
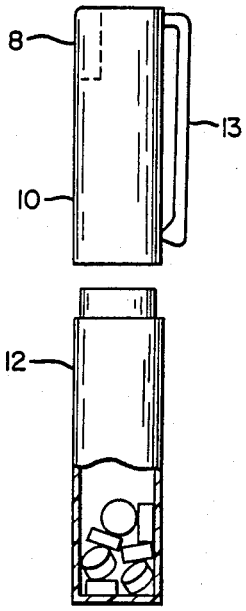
FIG. 2 is an exploded, partially sectional side view of an exemplary medication container having a top to mate with the exemplary self-contained timer of FIGS. 1 and 1*a*.
Figure 3:
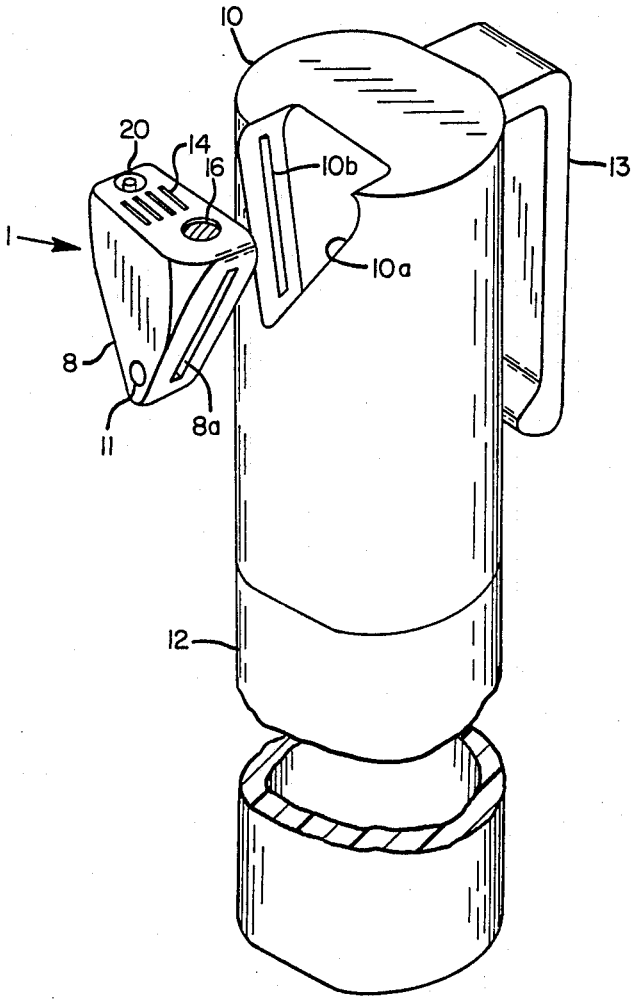
FIG. 3 is an exploded perspective view of the container of FIG. 2.

Referring to FIGS. 1–3, an exemplary embodiment of a self-contained timer 1 has a small housing of plastic 8 of any convenient portable shape approximately the size of a coin but somewhat thicker. Enclosed within the housing are a buzzer 14, an LED 16, a microchip 18 (refer to block schematic diagrams of FIGS. 4, 13 and 14), and a battery 13 (FIG. 13). The battery, and preferably the other elements as well, are permanently encapsulated within the housing 8 and thus nonremovable. The unit as a whole is intended to be disposed of when the unit becomes disabled as will be described below.

It is not necessary, for purposes of the invention, that the timer be physically connected to a medication container. Thus, if desired, the timer may be carried on the person attached by a Velcro or adhesive patch 9 to an article of clothing, or connected to a keychain or necklace passing through an aperture 11, or simply carried loose in a pocket. Alternatively, the unit may be snapped into the mating cavity 10*a* of a plastic cap 10 of a medication container 13 having a pocket clip 13, and carried in a pocket or purse. As shown best in FIG. 3, the LED 16 and the buzzer 14, as well as an externally accessible switch 20, are mounted on top of the unit when inserted in the cap 10 so as to be visible, audible, and accessible to the user, respectively. Mating lips 10*b* and grooves 8*a*, on the cap and housing respectively, help to retain the housing in the cavity 10*a*.

If the user is taking more than one type of medication, it is advisable to associate a separate timer unit with each medication because the operation of each timer unit is uniquely associated with a particular medication, as will be explained below.

The switch 20, which includes a plunger 22 and a pair of leaf spring contacts 24*a* and 24*b*, is mounted in a well 26 contained within the unit (refer to FIGS. 13 and 14). The well includes conductive contacts 28*a* and 28*b* which are connected by small leads respectively to the battery 13 and to the circuit components, i.e., the buzzer 14, LED 16 and chip 18. The leaf spring contacts 24*a* and 24*b* are also electrically connected to a contact 30 disposed on the bottom of the plunger 22. Inside the well 26 is another contact 32 which is connected to the initializing circuit of FIG. 5.

When the unit is to be placed in operation, the user depresses the plunger 22, by means of a pin or ball point pen tip 23, or the like, which carries leaf spring contacts 24*a* and 24*b* down into well 26. The leaf spring contacts collapse inwardly as the plunger 22 is forced into the well 26, but spring outwardly once the contacts clear the top of the well. When the contacts 24*a* and 24*b* spring outwardly they engage contacts 28*a* and 28*b*, thus completing a circuit from battery 13 to the remaining electrical components. At this point, however, the plunger contact 30 does not engage contact 32 because the plunger 22 is urged upwardly by coil spring 34. The spring contacts 24a and 24b, once inside the well 26, form a permanent latching retainer for plunger 22 and permanently connect the battery 13 to the other electrical components. Prior to such connection there is no drain on the battery, which maximizes the shelf life of the timer.

Figure 4:
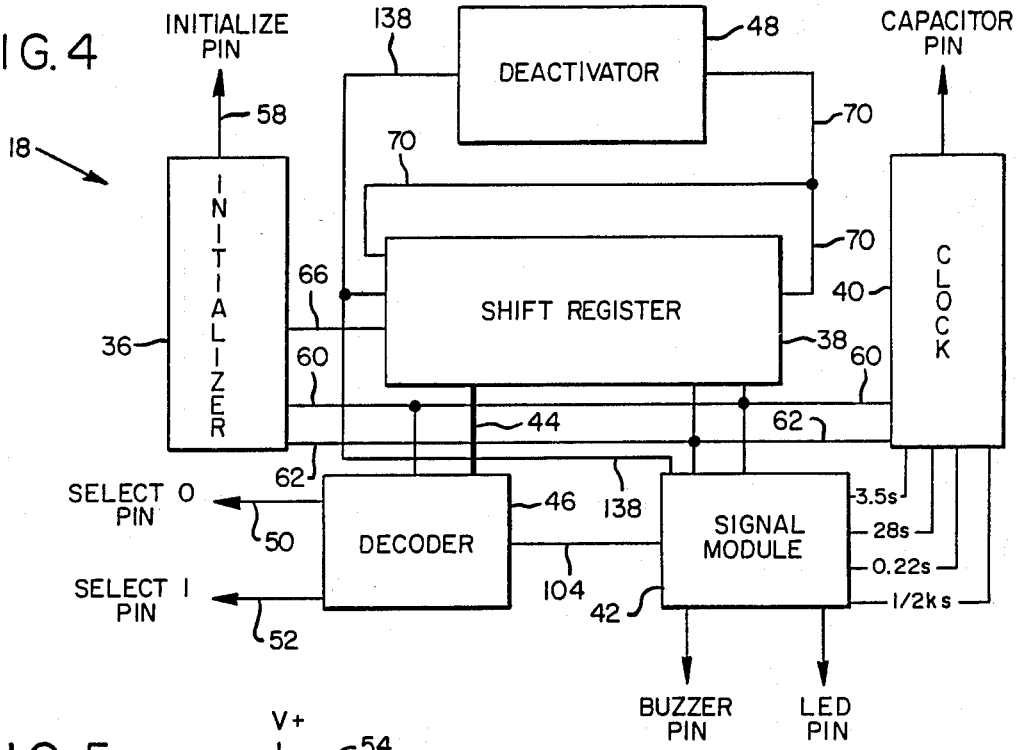
FIG. 4 is a block schematic diagram of an exemplary circuit for providing the alarm signals of the self-contained timer of FIG. 1.

Referring now to FIG. 4, the microchip 18 comprises a circuit which includes an initializer 36 which is responsive to an electrical input caused by the engagement of electrical contact 30 with initializer contact 32 when plunger 22 is momentarily further depressed against the resistance of coil spring 34. The initializer 36 is connected to a shift register 38 which also includes an input from clock 40. Clock 40 provides outputs of varying periods, to be explained in more detail below, to signal module 42. The primary output of the shift register 38 is over bus 44 to decoder 46. The decoder 46 includes two input pins, a select 0 pin 50 and a select 1 pin 52. The output of decoder 46 carries a signal bit to the input of signal module 42. Connected in parallel with shift register 38 is deactivator 48.

Figure 5:
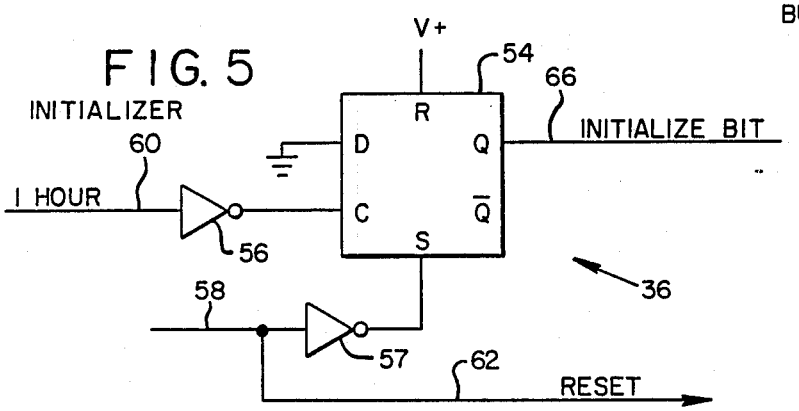
FIG. 5 is a schematic diagram of the initializing module of FIG. 4.

Referring to FIG. 5, the initializer 36 comprises a "D" flip-flop 54, having its "clock" input connected to an inverter 56 and its "set" input connected to inverter 57. The input to inverter 56 is a one-hour output line 60 from clock 40. Once every hour line 60 goes high briefly which causes the output of inverter 56 to go low. Line 58 is from the initializer contact 32, and goes high whenever the plunger 22 is depressed so as to cause contact 30 to touch contact 32. Whenever line 58 goes high the output of inverter 57, which is connected to the "set" input of flip-flop 54, goes low. As the "set" input goes low the "Q" output of flip-flop 54 goes high at line 66. This condition is cleared by the next pulse from clock line 60 which causes a positive edge triggering pulse from inverter 56 to be applied to the clock input. This causes Q to go low because it follows the state of the permanently grounded "data" input on each positive edge clock trigger. Thus, depressing the initializer plunger 22 generates an initialize bit on line 66, and a pulse from the clock 40 on line 60 clears it.

Figure 6:
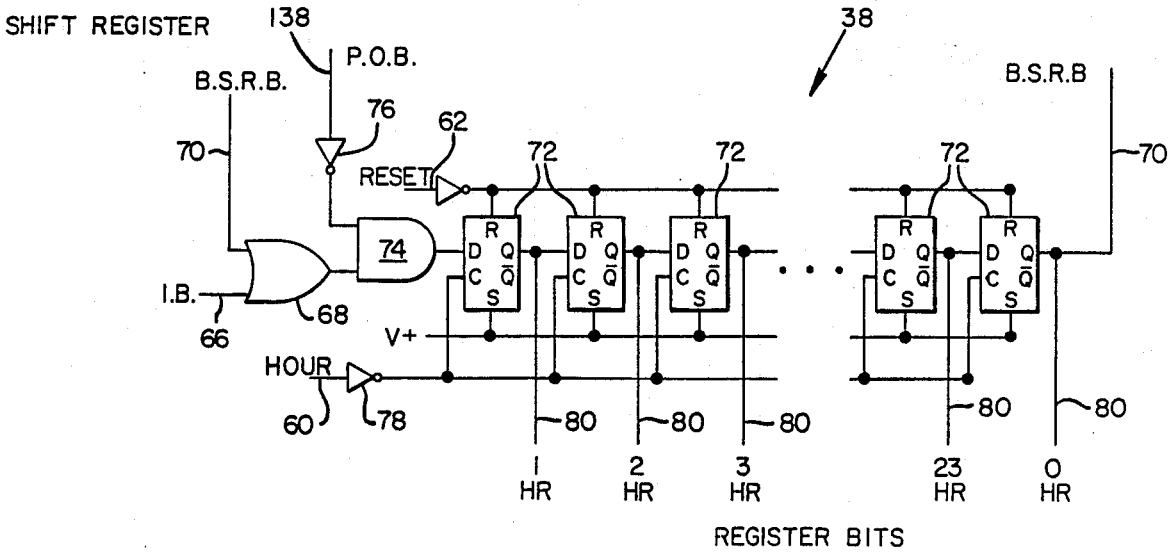
FIG. 6 is a schematic diagram of the shift register module of FIG. 4.

Referring to FIG. 6, line 66 which carries the initializer bit is connected to OR gate 68. The other input to OR gate 68 is a barrel shift register bit line 70. This line begins at the Q output of the last flip flop in shift register 38, which comprises twenty-four cascaded D flip flops 72. The output of OR gate 68 is connected to an input of AND gate 74. The other input to AND gate 74 is the output of inverter amplifier 76 which is connected to the deactivator 48. The clock input of each of the D flip flops 72 is connected to the output of an inverting amplifier 78 which is in turn connected to line 60, the one hour clock output.

A pulse on initializer line 66 or on the barrel shift register bit line 70 will cause the output of AND gate 74 to go high. This is because the output of inverter 76 is always high unless the deactivator 48 has timed out, at which point the output of inverter 76 will go low permanently, thus inhibiting any input to the first of the D flip flops 72. When the output of AND gate 74 is high, however, this state will be latched into the first of the D flip flops by a clock pulse from inverting amplifier 78, which will occur once every hour in response to the low-to-high transition at the output of inverter 78. In the absence of an initializer bit on line 66 or a barrel shift register bit on line 70, the high state on the first of the D flip flops 72 will be clocked sequentially through the shift register in one hour increments until, after 24 hours, it reaches the last of the D flip flops 72. When the high active pulse reaches the Q output of the last of the D flip flops 72 it appears on barrel shift register bit line 70 and is recycled back to OR gate 68 where it initiates another 24 hour cycle. Therefore, once every hour one of the Q outputs of flip flops 72 goes high in succession and this output appears on each of the Q output lines 80 in succession, at one hour intervals.

Figure 7:
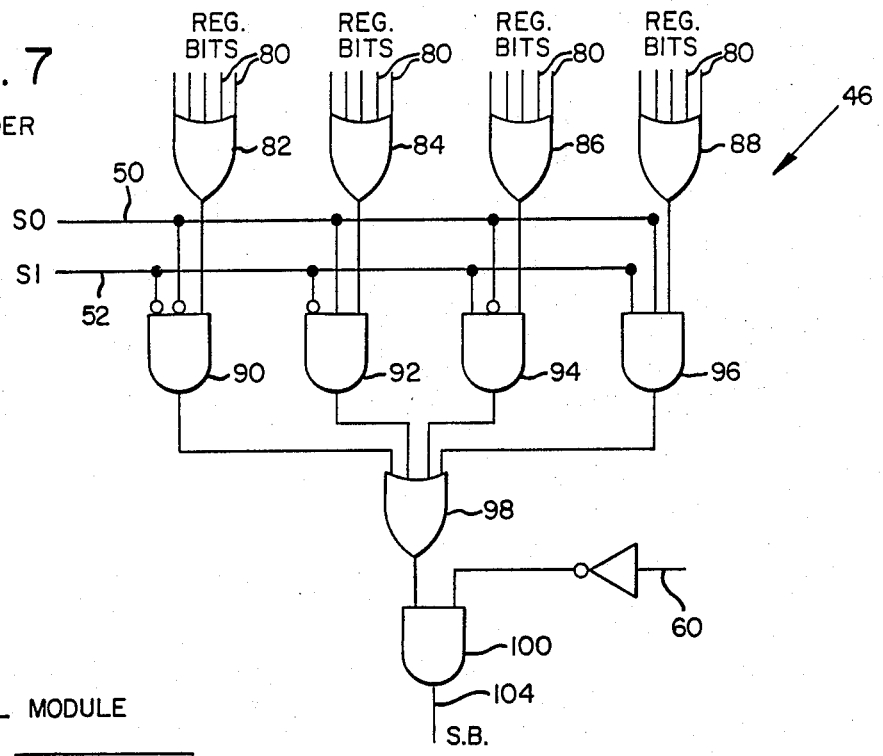
FIG. 7 is a schematic diagram of the decoder module of FIG. 4.

Referring to FIG. 7, the shift register output lines 80 contained in bus 44 are connected to a decoder 46 which includes a plurality of OR gates 82, 84, 86 and 88. The outputs of OR gates 82, 84, 86 and 88 are connected to AND gates 90, 92, 94 and 96 respectively. The outputs of AND gates 90, 92, 94 and 96 are connected to an OR gate 98 which is in turn connected to AND gate 100. Decoder input lines S0 and S1 correspond to pins 50 and 52 of FIG. 4 and are used during manufacture to fixedly select a group of output lines 80 connected to one of the OR gates 82, 84, 86 or 88. This enables each unit to be wired exactly the same way except for the selection during assembly of the logic level on pins 50 and 52. Depending upon whether pins 50 and 52 are both high, both low, line 50 high and line 52 low, or vice versa, one group of outputs 80 from the shift register module 38 will be chosen.

An example is provided in FIG. 11 which shows outputs 80 from the shift register 38 connected to various ones of the cascaded D flip flops 72. Each number labeling each of the D flip flops 72 represents a one hour increment. AND gate 90 is wired to the D flip flops 72 which represent three intervals of four-hour periods and a single twelve-hour period. AND gate 92 is wired to flip flop outputs representing 12-hour intervals only and AND gate 94 is wired for four 3-hour intervals with a 12-hour interval in between. AND gate 96 is wired for a single 24-hour period. A 1 of 4 decoder 102 chooses one of the AND gates 90, 92, 94 or 96, since only one of the four output lines of the 1 of 4 decoder 102 will be high. The decoder 102 performs the same function as represented by the logic state inputs to AND gates 90, 92, 94 and 96 from pins S2 and S0 as shown in FIG. 7. Decoder 102 is simply a schematic representation of these logic choices. Which output of decoder 102 is high depends on the logic states of pins 50 and 52 fixed during assembly. The particular timings that may be chosen from the example of FIG. 11 are shown in FIG. 12. If both S1 (pin 52) and S0 (pin 50) are low, gate 90 is chosen which results in a nonuniform pattern of multiple timing intervals of four hours separated by a longer interval of 12 hours once per clock cycle. If S1 is low and S0 is high, gate 92 is selected which results in uniform timing intervals of 12 hours. If S1 is high and S0 is low, gate 94 is chosen which results in a nonuniform pattern of multiple timing intervals of three hours separated by a longer interval of 12 hours once per clock cycle. If both S1 and S0 are high, gate 96 is selected which provides a 24-hour timing interval. Thus, S0 and S1 variations are capable of fixedly selecting either uniform or nonuniform patterns of timing command signals from the shift register 38, which nonuniform signals may include multiple short intervals between signals, interspersed with a lesser number of longer intervals between signals. This enables a pattern of timing command signals which allows for a sleeping period, during which the alarm will not provide a user perceptible signal. Since the unit may be initialized at any time, all that is necessary to synchronize the unit to the user's waking/sleeping cycle is to initialize the unit upon rising or at some predetermined time of the day which corresponds to the user's real time clock cycle.

As previously stated, the choice of pattern of the timing signals, which depends upon the selection of certain combinations of lines 80 from shift register 38, is fixed during assembly. For example, the simplest method of impementing the function of the 1 of 4 decoder 102 is to connect both S1 and S0 to a high logic signal source and then selectively cut the lines during assembly. Thus, in accordance with the table of FIG. 12, there are four possible timing command signal patterns available from the particular example of FIG. 11. However, other timing patterns could be used as well. For example, lines 80 could be connected to shift register 38 at D flip-flops 72 which are only two hours apart, or even one hour apart, or a combination of one and two hours apart, or any other combination of intervals desired. Also, a shorter sleeping interval could be provided, such as eight hours. The cooperative shift register/decoder principle of FIG. 11 therefore makes it possible for the manufacturer or assembler to choose, in a very simple and versatile manner, between one of multiple possible timing patterns. This promotes efficiency and economy in the assembly process, since large numbers of units may be wired identically and the only variation need be the fixing of the logic states for S1 and S0.

Since the time intervals are fixed and non-programmable once manufacture is complete, the user must select the particular type of timer which has the desired pattern of timing command signals appropriate for his particular medication and sleeping habits. This pattern may be identified by a fixed color coding of the plastic housing 8 holding the timer 1, or by other visual indicia such as number coding or housing shape. For example, all units having a four-hour interval could include a plastic housing 8 of a first color, and all units having a three-hour interval could be identified by a second color, and so forth for as many different patterns of intervals as are offered. Furthermore, the color coding or other visual indicia could identify those units having nonuniform time intervals, and identify the length of the longer intervals which are interspersed among the shorter intervals as described above.

Figure 8:
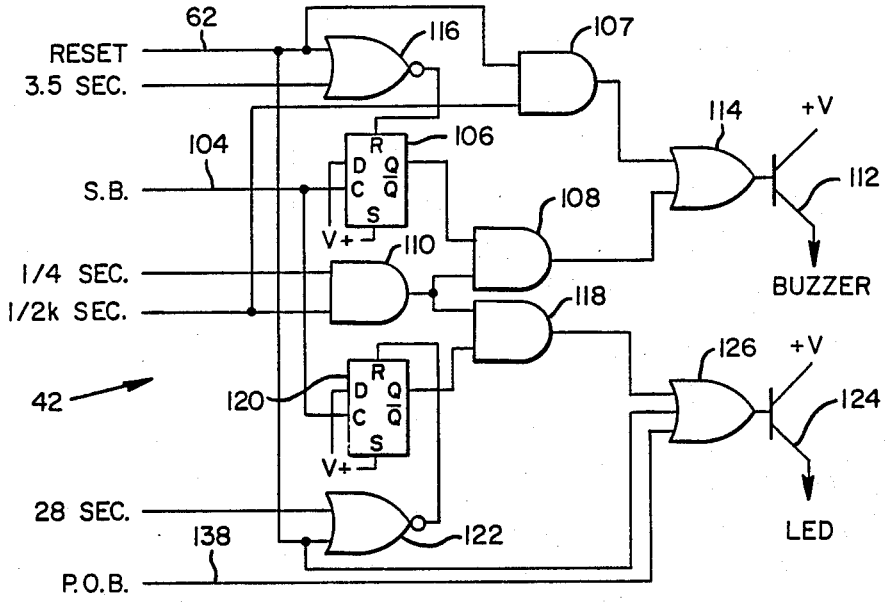
FIG. 8 is a schematic diagram of the signal module of FIG. 4.

Some users, particularly the elderly, may be taking several different types of medication at the same time. In such a case, multiple timers can be used simultaneously, each associated with a different medication. However, under such conditions, the user could become confused as to which unit is providing the signal since many users would keep all such timers together in one place, such as in a purse or pocket. Therefore, in FIG. 8 an alarm module is shown which both audibly and visually identifies the particular timer 1 which is signalling the need to take medication, and which does so by providing a visual signal of substantially longer duration than the audible one. In this way, the benefit of an audible signal (alerting the user when the timer is out of sight) is retained compatibly with the benefit of a long-duration signal (giving the user sufficient time to identify the particular timer which sounded the alarm) without excessive battery energy consumption or noise disturbance. A signal bit line 104, from AND gate 100 in decoder 46, is the clock input to D flip-flop 106. The output of flip flop 106 is connected to one input of AND gate 108. The other input to AND gate 108 is the output of AND gate 110 which is in turn connected to a pair of inputs from clock 40. These inputs are the one-fourth second and ½ K second outputs of clock 40 respectively. Thus, every other 0.25 seconds AND gate 110 goes periodically high at a 2048 Hz frequency. Thus, whenever the signal bit goes high on line 104, AND gate 108 periodically goes high every 0.25 seconds. A buzzer 14 is driven by transistor 112 which is connected to the output of OR gate 114. The D flip-flop 106 is reset every 3.5 seconds by the output of NOR gate 116 which includes inputs from the reset line 62 and from the 3.5 second output of clock 40. Thus, whenever the signal bit goes high on line 104 the D flip-flop 106 clocks a high pulse through to AND gate 108 for 3.5 seconds, thereby activating the buzzer. The ½ K second input is also connected to AND gate 107 which has a second input from the reset line 62. Thus, the buzzer sounds whenever initialization occurs to give audible confirmation of a reset condition.

With respect to the LED 16, the output of AND gate 110 is connected to the input of AND gate 118 and the other input to AND gate 118 is from D flip-flop 120. D flip-flop 120 is connected through its reset pin to NOR gate 122 which includes inputs from the 28 second line of clock 40 and the reset line 62. The LED 16 is driven by transistor 124 which is connected to the output of OR gate 126. The operation of the LED is substantially the same as that described above in connection with buzzer 14. However, the LED will flash for 28 seconds while the buzzer is only audible for 3.5 seconds. This is because a user may hear the buzzer, but it may be some time before the particular unit can actually be located. When the unit is located, the flashing LED confirms the identify of the particular unit that sounded the buzzer. This permits the user to identify which one of a number of timing units sounded its alarm indicating the need to take medication, without unduly draining the battery or causing noise disturbance by prolonged actuation of the buzzer. The LED will also turn on whenever line 138 goes high. This occurs at the end of 32 days when the deactivator 48 produces an output pulse, as will be explained below.

Figure 9:
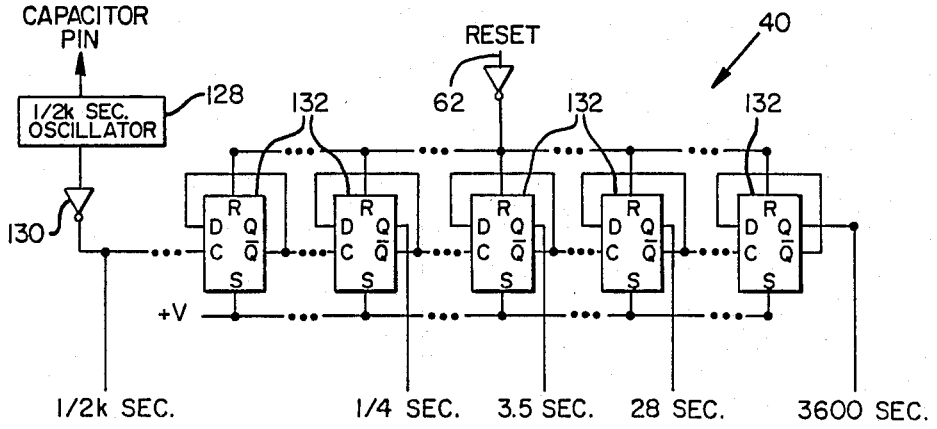
FIG. 9 is a schematic diagram of the clock module of FIG. 4.

The clock module 40 is shown in FIG. 9. A 2000 Hz oscillator 128 provides pulses through an inverting amplifier 130 to a series of D flip-flops 132 which are cascaded to form a divider to divide down the oscillator output into various periods. These periods are one-fourth second, 3.5 seconds, 28 seconds and one hour. All of the outputs of the clock 40 may be reset by the reset line 62 with the exception of the direct oscillator 128 output which is the audio signal needed to provide reset confirmation through AND gate 107 (FIG. 7).

Deactivator circuit 48 is shown in FIG. 10. The input to deactivator circuit 48 is a pulse on line 70 from the output of shift register 38 termed the "barrel shift register bit" which is connected to the clock input of the first of a series of D flip-flops 134 through inverting amplifier 136. Once every 24 hours this pulse appears at the output of shift register 38 on line 70, restarting the clock cycle of shift register 38. This pulse is clocked through deactivator circuit 48 in a period of 32 days. At the end of 32 days a high logic state appears on line 138 which is connected to the input of inverting amplifier 76 (refer to FIG. 6). Once line 138 goes high it stays high and therefore the input to AND gate 74 (FIG. 6) goes low, which prevents shift register 38 from starting a new clock cycle. This in turn means that lines 80 will be low and therefore no signal will appear at the output of AND gate 100 on signal bit line 104. This effectively disables the unit after a predetermined time period of 32 days, which condition is visible because of the steady illumination of LED 16 due to the connection of line 138 to the signal module as previously described with respect to FIG. 8. Thus, when 32 days expires, the unit may simply be thrown away. Since 32 days is well within the capability of the unit's battery 13, timing errors which would normally occur as the battery 13 weakens are avoided.

Thus, in actual operation, the user purchases a timer 1 and permanently energizes the unit by depressing plunger 22. Once the unit is energized it may be initialized by depressing plunger 22 further. The unit is then synchronized to the user's schedule and will continue to provide alarm signals consisting of the audible signal and the flashing signal for a period of 32 days, at which time the unit will permanently and automatically disable itself. The unit may be reinitialized, repeatedly if needed, at any time prior to disabling by depressing the plunger 22, but the pattern of timing command signals fixed during manufacture will always remain the same. The particular pattern of timing command signals is communicated to the user through the use of a unique color code or other fixed visual indicia on the housing.

All of the circuitry described herein may be manufactured on a single custom silicon chip 18 thus providing a small, lightweight, and inexpensive disposable timer. The battery 13, and preferably all of the other components of the timer, are permanently encapsulated within the plastic housing 8, and there is never an opportunity or need to replace the battery 13 since the unit will disable itself long before the battery 13 wears out. This provides much greater economy and reliability in such units since it avoids the use of friction contacts which may become corroded or fail to mate properly when the battery is replaced.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A self-contained timer for providing signals at predetermined time intervals comprising:

(a) a housing;

(b) selectively energizable timing and signal means within said housing for providing said signals at automatically-successive, permanently-fixed time intervals in a single permanently-fixed pattern of said intervals;

(c) externally-accessible switch means on said housing for energizing said timing and signal means;

(d) permanently-fixed visual indicia means associated with said housing for identifying said single permanently-fixed pattern; and (e) self-regulated deactivator means for permanently disabling said timing and signal means in response to the lapse of a fixed period of time.

2. The self-contained timer of claim 1 wherein said timing and signal means includes means for providing said signals at automatically successive, fixed, non-uniform time intervals comprising multiple first intervals interspersed with second intervals of fewer number and longer duration than said first intervals.

3. The self-contained timer of claim 1 wherein said visual indicia means comprises a visible color code on said housing.

4. A self-contained timer for providing signals at perdetermined time intervals comprising:

(a) a housing;

(b) selectively energizable timing and signal means within said housing for providing said signals at automatically-successive time intervals in response to initialization of said timing and signal means;

(c) externally-accessible switch means on said housing for selectively initializing and reintializing said timing and signal menas in synchronization with starting times chosen by the user, without thereby de-energizing said timing and signal means; and (d) said switch means further including means for selectively energizing said timing and signal means, said switch means including a single externally-accessible switch actuator means for causing said switch means selectively to energize, initialize and reinitialize said timing and signal means.

5. The self-contained timer of claim 4 wherein said timing and signal means includes means for providing said signals at automatically successive, fixed, non-uniform time intervals comprising multiple first intervals interspersed with second intervals of fewer number and longer duration than said first intervals.

6. The self-contained timer of claim 4, further including latching means for permanently preventing said switch means from deenergizing said timing and signal means.

7. The self-contained timer of claim 4 wherein said switch means comprises means defining an internal well in said housing having electrical contacts, a plunger, and leaf spring means attached to said plunger for expanding against said electrical contacts to complete an electrical circuit between said contacts in response to the depression of said plunger a predetermined distance into said well.

8. A self-contained timer for providing signals at predetermined time intervals comprising:

(a) a housing;

(b) selectively energizable timing and signal means within said housing for providing said signals at automatically-successive time intevals in response to initialization of said timing and signal means;

(c) externally-accessible switch means on said housing for selectively initializing and reinitializing said timing and signal means in synchronization with starting times chosen by the user, without thereby de-energizing said timing and signal means;

(d) said switch means comprising means defining an internal well in said housing having electrical contacts, a plunger, and leaf spring means attached to said plunger for expanding against said electrical contacts to complete an electrical circuit between said contacts in response to the depression of said plunger a predetermined distance into said well, spring means for urging said plunger in an outward direction from said internal well, and a further electrical contact situated inside said well for momentarily conductively contacting said leaf spring means when said plunger is depressed into said well a distance greater than said predetermined distance.

9. A self-contained timer for providing signals at predetermined time intervals comprising:

(a) a housing;

(b) selectively energizable timing and signal means within said housing for providing said signals at automatically-successive time intervals in response to initialization of said timing and signal means;

(c) externally-accessible switch means on said housing for selectively initializing and reinitializing said timing and signal means in synchronization with starting times chosen by the user, without thereby de-energizing said timing and signal means;

(d) said switch means comprising means defining an internal well in said housing having electrical contacts, a plunger, and leaf spring means attached to said plunger for expanding against said electrical contacts to complete an electrical circuit between said contacts in response to the depression of said plunger a predetermined distance into said well, said leaf spring means including means for permanently retaining said plunger in a depressed position inside said well after said plunger has been depressed said predetermined distance into said well.

10. A self-contained timer for providing signals at predetermined time intervals comprising:

(a) switch means for selectively initializing said timer;

(b) clock means having a clock cycle for providing at least one pulse at a predetermined time during said clock cycle;

(c) shift register means responsive to said switch means and to said pulse for providing timing commands at predetermined time intervals within said clock cycle, said shift register means comprising multiple flip-flops each having an input and an output and interconnected in series so that the output of one flip-flop is connected to the input of the next flip-flop in the series;

(d) decoder means for selecting a predetermined pattern of some, less than all, of said timing commands;

(e) multiple parallel electrical conductors, each interconnecting the output of a different flip-flop of said shift register means with said decoder means, for conducting said timing commands from said shift register means to said decoder means;

(f) signal means responsive to said predetermined pattern of timing commands for providing said signals at times corresponding to the occurrence of the timing commands in said predetermined pattern; and (g) a battery for operably energizing said timer, a housing containing said timer and permanently encapsulating said battery, said self-regulated deactivator means for permanently disabling said timing commands in response to the lapse of a fixed period of time while said battery contains sufficient energy to operably energize said timer.

11. A self-contained timer for providing signals at predetermined time intervals comprising:

(a) switch means for selectively initializing said timer;

(b) clock means having a clock cycle for providing at least one pulse at a predetermined time during said clock cycle;

(c) shift register means responsive to said switch means and to said pulse for providing timing commands at predetermined time intervals within said clock cycle, said shift register means comprising multiple flip-flops each having an input and an output and interconnected in series so that the output of one flip-flop is connected to the input of the next flip-flop in the series;

(d) decoder means for selecting a predetermined pattern of some, less than all, of said timing commands;

(e) multiple parallel electrical conductors, each interconnecting the output of a different flip-flop of said shift register means with said decoder means, for conducting said timing commands from said shift register means to said decoder means;

(f) signal means responsive to said predetermined pattern of timing commands for providing said signals at times corresponding to the occurrence of the timing commands in said predetermined pattern; and (g) said switch means comprising a permanently latching first set of electrical contacts for energizing said timer, and a nonlatching second set of electrical contacts for selectively initializing said timer.

12. The self-contained timer of claim 11 wherein said shift register means and decoder means comprise means for repeating said pattern of timing commands once every clock cycle, and wherein said decoder means includes means for selecting said pattern of timing commands to occur at non-uniform time intervals comprising multiple first intervals combined with one or more second intervals of fewer number and longer duration than said first intervals.

13. The self-contained timer of claim 11, further including a battery for operably energizing said timer, and a housing containing said timer and permanently encapsulating said battery.

14. The self-contained timer of claim 11 wherein said switch means includes means for operating said first set of electrical contacts independently of said second set of electrical contacts.

* * * * *

UNITED STATES PATENT AND TRADEMARK OFFICE

CERTIFICATE OF CORRECTION

PATENT NO. : 4,849,948

DATED : July 18, 1989

INVENTOR(S) : Bradley D. Davis et al.

It is certified that error appears in the above-identified patent and that said Letters Patent is hereby corrected as shown below:

Col. 6, line 64, Change "nonunifcrm" to --nonuniform--.

Col. 7, line 11, Change "impementing" to --implementing--.

Col. 10, line 15, Change "menas" to --means--.

Signed and Sealed this

Seventh Day of January, 1992

*Attest:*

HARRY F. MANBECK, JR.

*Attesting Officer*

*Commissioner of Patents and Trademarks*